United States Patent [19]

Le Houillier

[11] Patent Number: 4,628,980

[45] Date of Patent: Dec. 16, 1986

[54] LOUVER SYSTEM

[75] Inventor: James G. Le Houillier, Ft. Lauderdale, Fla.

[73] Assignee: Profile Industries Corporation

[21] Appl. No.: 206,862

[22] Filed: Nov. 14, 1980

[51] Int. Cl.[4] ..... E06B 9/36; E06B 9/386

[52] U.S. Cl. ..... 160/166 A; 160/236

[58] Field of Search ..... 160/236, 166, DIG. 7, 160/136; 40/611, 120

[56] References Cited

U.S. PATENT DOCUMENTS

| | | | |
|---|---|---|---|
| 2,074,482 | 3/1937 | Martens | 160/DIG. 7 |
| 2,121,217 | 6/1938 | Ellis . | |
| 2,534,673 | 12/1950 | Holland . | |
| 4,049,038 | 9/1977 | Hyman et al. | 160/166 A |
| 4,195,680 | 4/1980 | Hyman et al. | 160/166 A |
| 4,296,792 | 10/1981 | Gidge et al. | 160/332 |

*Primary Examiner*—Ramon S. Britts
*Assistant Examiner*—Cherney S. Lieberman

[57] ABSTRACT

A louver having clear transparent C-shaped holding flanges for holding decorative panels. The transparent holding flange on each longitudinal edge of each louver in a vertical louver system is held vertical by a louver track system. The louvers are moveable from an overlapped closed position to an open position. Each louver has a main body portion of opaque material. The C-shaped holding flanges or edge portions include two transparent longitudinal edge portions, one on each longitudinal edge of the long louver. The transparent edge portion is equal in width to a transparent inwardly facing flange portion positioned over each longitudinal edge portion. The transparent edge portion and transparent inwardly facing portion are connected together and separated by a transparent mid portion of a width generally equal to the thickness of a decorative member. The transparent material allows the edges of an inserted piece of decorative material to be viewed through the transparent, inwardly facing portions.

4 Claims, 7 Drawing Figures

LOUVER SYSTEM

BACKGROUND OF THE INVENTION

In the past, opaque louvers were designed with holding flanges to hold decorative panels. Such louvers are disclosed in U.S. Pat. No. 4,049,038 and U.S. Pat. No. 4,195,680. The prior art louvers are not satisfactory because the appearance of the decorative panels are destroyed by vertical lines of the color of the louver holding flanges.

BRIEF DESCRIPTION OF THE INVENTION

A new and improved vertical louver having a long thin panel with a flange on each longitudinal edge. Each flange extends inward a short distance toward the other longitudinal edge and is positioned on the same side of the panel to form the decorative panel holding channels. The channel is generally C-shaped and of transparent material. The two clear transparent C-shaped louver edge portions on each louver provide a new and improved louver system when a plurality of louvers are used. The louver system comprises a plurality of louvers held vertically by a louver track system. Each louver has a main body portion of an opaque material, for example white, with clear transparent C-shaped edge portions. Each C-shaped edge portion includes a longitudinal edge portion and inwardly facing flange portion both of which are of clear transparent material and both of which are preferably of the same width. The C-shaped edge portions may be placed on the exterior side of a louver as well as the interior side of the louver.

Each C-shaped edge portion includes a longitudinal edge portion, a mid or an outwardly projecting portion and an overlying inward facing portion. Each of the longitudinal edge portions of the louver and the overlying portions are preferably equal in width and are preferably spaced from one another a distance equal to the thickness of a decorative panel. The material provides a total transparent edge.

The clear transparent C-shaped edge portions eliminate the vertical striped lines that appeared in an interior view of older louver systems having a decorative panel in each louver, when they were in a closed configuration. The older totally opaque colored louvers with colored opaque edges detract from the decorative panels secured in the louvers. The new and improved transparent edges allow the inserted piece of decorative material, when viewed from the interior side, to be seen through the transparent C-shaped edge portions. When the louver is viewed at greater distance from the exterior side, the transparent edges allow the exterior of the decorative material or panel to be seen. The exterior of the decorative material or panel is usually a bland color. Since the distance of normal viewing of the exterior of such louvers is relatively great, the bland vertical line seen through the transparent material will not detract from the overall appearance.

If the decorative material does not reach totally across a louver, between the two transparent C-shaped edge portions, the space left will be in the region of the transparent material and therefore one will be able to see through the transparent material to the next adjacent overlapping decorative louver. The decorative panel or material will be seen when viewing the interior of the louver system. The opaque back of the next adjacent overlapping louver will be seen when viewing the exterior of the louver system.

It is an object of this invention to provide vertical louvers having C-shaped longitudinal edges in a transparent material to provide a view through the material of the longitudinal edge portions of the decorative material.

It is another object of this invention to provide a vertical louver with a decorative panel without a vertical strip caused by an opaque longitudinal louver decorative panel holding device.

In accordance with these and other objects which will be apparent hereinafter, the instant invention will now be described with particular reference to the accompanying drawings.

DESCRIPTION OF THE PREFERRED EMBODIMENTS

Figure 1:
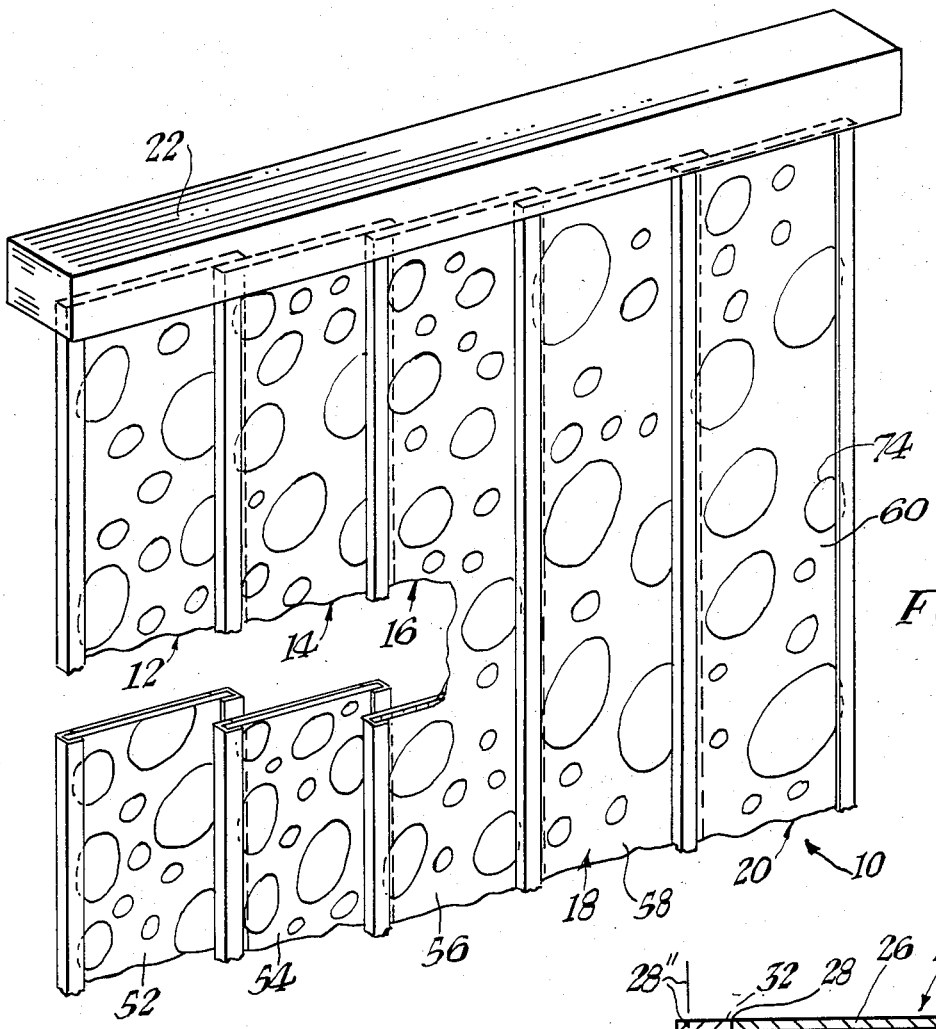
FIG. 1 is an isometric view of the interior of the vertical louver system in a closed overlapping condition partially cut away.
Figure 2:
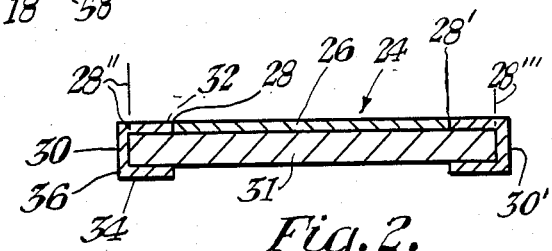
FIG. 2 is a top cross sectional view of a vertical louver with transparent edge holding means.

Referring to FIGS. 1 and 2, the new and improved vertical louver system illustrated generally by numeral 10 in FIG. 1 includes a plurality of louvers 12, 14, 16, 18 and 20 held vertically by a louver track system 22. Each louver has a decorative panel 52, 54, 56, 58 and 60. Each louver as shown in FIG. 2 has a body 24 with a main portion 26 of opaque material that may be of any color. On the longitudinal edges 28 and 28' of each louver is at least one generally C-shaped flange 30 and 30'. The C-shaped flange includes a transparent longitudinal edge portion 32, an inward transparent facing portion 34 of equal length and a transparent mid portion 36. The C-shaped flange provides a notch sized to accept the decorative panel 31.

Figure 3:
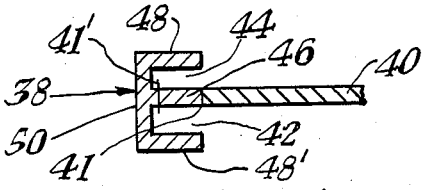
FIG. 3 is a partial top cross sectional view of another louver with transparent edge holding means.

There may be additional flange members on the rear of the vertical louver as shown in FIG. 3. The transparent decorative holding flange 38 is generally E-shaped. The opaque portion of the flange is illustrated by numeral 40. The decorative panel may be placed in notch 42 and or in notch 44. The transparent, outwardly projecting portion or edge portion 46 and the overlying transparent portions 48 and 48' may be made of clear transparent material of equal length. The mid portion 50 may also be made of transparent clear material.

Figure 4:
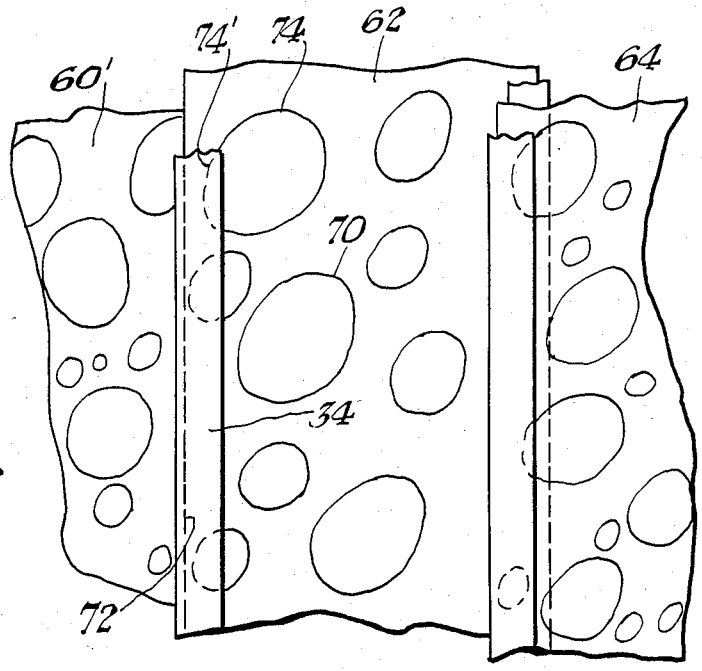
FIG. 4 is a partial interior view of closed overlapping louvers with a decorative panel.
Figure 5:
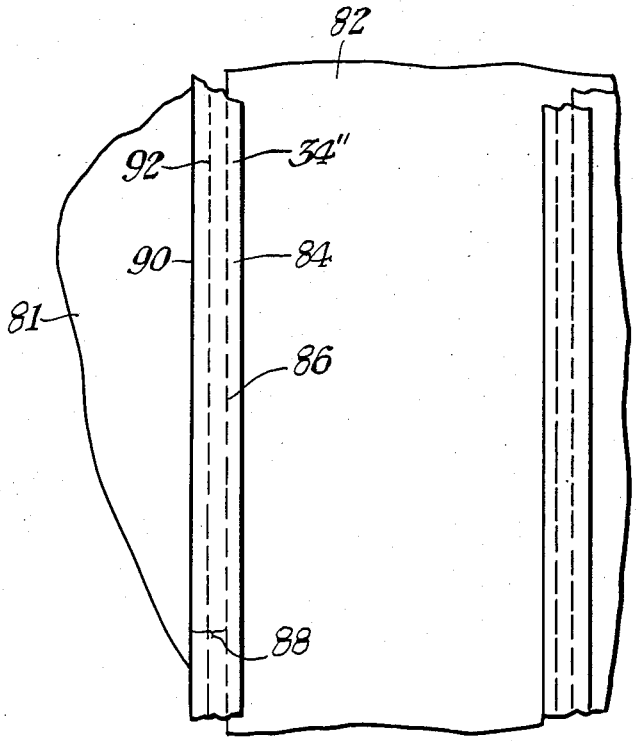
FIG. 5 is a partial exterior view of closed overlapped louvers with a decorative panel.

The clear transparent material does away with vertical striped lines of the color in the older vertical louver panels with colored opaque holding means. The older holding means normally differ in color from the decorative panel connected in the louver. The lines would show up in an interior view of the older louver system when the louvers were closed. The clear transparent material used in the new and improved louver system as shown in FIGS. 1, 4 and 5 allow an inserted piece of decorative material illustrated with circles to be viewed from the interior without detracting vertical lines. The longitudinal edges of the decorative panels 52, 54, 56, 58, 60, 62 and 64 may be seen through the transparent C-shaped edges of the overlying louver.

In FIG. 4, circle 74 on decorative panel 62 is viewable through the transparent facing portion 34. The edge of the decorative panel 62 is shown by dashed lines 72. In FIG. 4, panel 62 is illustrated in a width that does not extend the full width between the C-shaped flanges. Therefore the circle 74 on panel 60 may be viewed at 74' through the C-shaped flange 34 up to the edge of panel 62.

In FIG. 5, the rear surface of the decorative panel 82 is viewable through the transparent facing portion 34'' as shown by numeral 84. The edge of the decorative panel 82 is shown by dashed lines 86. In FIG. 5, panel 82 is illustrated in a width that does not extend the full width between the C-shaped flanges. Therefore the back of panel 81 may be viewed at 88 through the C-shaped flange 34'' up to the edge of panel 82.

Figure 6:
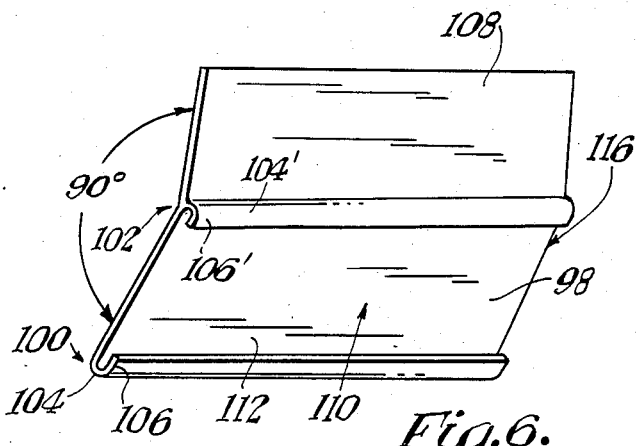
FIG. 6 is an isometric view of a valance.
Figure 7:
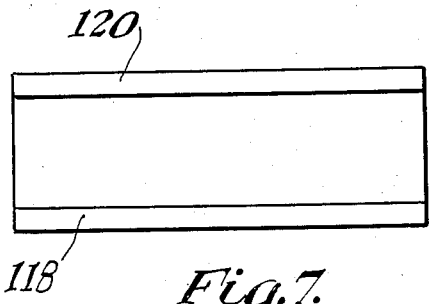
FIG. 7 is a side view of one side valance portion.

FIGS. 6 and 7 illustrate a valance 98 constructed with clear transparent edge portions 100 and 102. Portions 104 and 106, 104' and 106' are of clear transparent material. The valance 98 has an opaque horizontal top 108 and an opaque vertical portion 110 at a 90° angle to the top. The decorative panel or fabric will fit in area 112 between edge portions 100 and 102. The vertical panel is opaque so that one cannot see through the transparent decorative panels or fabric to view the louver track system behind the valance. FIGS. 6 and 7 show side panels that fit onto the vertical member of the valance by a corner clip or valance corner, not shown, as at 116. The edge portions 118 and 120 are transparent and shaped like edges 100 and 102.

The clear transparent material may start at 28'' and 28''' as illustrated in FIG. 2 instead of at 28 and 28'. In this embodiment where the clear transparent material starts at 28'' and 28''' the exterior view in FIG. 5 would show the exterior of louver 81 only between edge 90 and dotted line 92. The louver is opaque from dotted line 92 to the right.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A louver system comprising a louver track system and a plurality of louvers, each said louver being held vertically by said track system and comprising an elongate, substantially rectangular, opaque main body portion having decorative panel holding means along each longitudinal edge for connecting an elongate, substantially rectangular decorative panel to said main body portion, each said panel holding means comprising a clear transparent generally C-shaped edge portion including a longitudinal edge portion attached to one of the longitudinal edges of said main body portion, a mid portion and an overlying inwardly facing portion, said mid portion connecting and separating said longitudinal edge portion and said inwardly facing portion, said C-shaped edge portion providing a notch sized to accept a longitudinal edge of said decorative panel.

2. The louver system of claim 1 wherein the longitudinal edge portion and the inwardly facing portion are equal in width.

3. The louver system of claim 1 or 2 wherein the longitudinal edge portion and the inwardly facing portion are spaced from one another a distance equal to the thickness of the decorative panel.

4. A louver system comprising a louver track system and a plurality of louvers, each said louver being held vertically by said track system and comprising an elongate, substantially rectangular, opaque main body portion having decorative panel holding means along each longitudinal edge for connecting up to two elongate, substantially rectangular decorative panels to said main body portion, each said panel holding means comprising a clear transparent generally E-shaped edge portion including a longitudinal edge portion attached to one of the longitudinal edges of said main body portion, a mid portion, and two overlying inwardly facing portions, said mid portion connecting and separating said inwardly facing portions and said longitudinal edge portion, each said inwardly facing portion being spaced from said longitudinal edge portion a distance equal to the thickness of the decorative panel.

* * * * *